US005131243A

United States Patent [19]

Coleman

[11] Patent Number: 5,131,243

[45] Date of Patent: Jul. 21, 1992

[54] ADJUSTABLE FINGER RING

[76] Inventor: Sammy L. Coleman, 5125 Highway 16, Rapid City, S. Dak. 57701

[21] Appl. No.: 794,974

[22] Filed: Nov. 20, 1991

[51] Int. Cl.[5] ..... A44C 9/02

[52] U.S. Cl. ..... 63/15.65; 63/15.5

[58] Field of Search ..... 63/15, 15.45, 15.5, 63/15.65, 15.7; 24/20 R, 20 EE, 23 R, 23 EE, 23 W; 285/252

[56] References Cited

U.S. PATENT DOCUMENTS

| | | | |
|---|---|---|---|
| 293,831 | 2/1884 | Wickers | 63/15.5 |
| 1,434,981 | 11/1922 | Ballard | 63/15.5 |
| 2,113,443 | 4/1938 | Eggerss | 24/20 EE |
| 2,216,249 | 10/1940 | Nelson | 285/252 |
| 2,582,083 | 1/1952 | Tarter et al. | 63/15.7 |
| 3,228,208 | 1/1966 | Silverman | 63/15.65 |
| 3,804,307 | 4/1974 | Johnston | 63/15.65 |
| 4,543,691 | 10/1985 | Calmettes | 24/23 W |

FOREIGN PATENT DOCUMENTS

| | | | |
|---|---|---|---|
| 2484649 | 2/1982 | France | 63/15.5 |
| 2602125 | 2/1988 | France | 63/15.5 |
| 591317 | 4/1959 | Italy | 63/15.65 |

*Primary Examiner*—Renee S. Luebke
*Assistant Examiner*—Michael J. Milano
*Attorney, Agent, or Firm*—Zarley, McKee, Thomte, Voorhees & Sease

[57] ABSTRACT

An adjustable finger ring, comprising a shank having spaced apart ends to define an adjustment gap. A spring extends from one end of the shank and is adapted to engage teeth or serrations of either a channel member or insert secured to the other end of the shank. A cap embraces the inner surface of the ring shank and embraces the adjustment gap and is secured to either the serrated tooth member or a separate channel member to maintain the components in place. The shank may be expanded to fit a variety of ring sizes.

8 Claims, 2 Drawing Sheets

ADJUSTABLE FINGER RING

BACKGROUND OF THE INVENTION

This invention relates to a finger ring and more particularly to an adjustable finger ring which may be adjusted to fit a variety of ring finger sizes.

Finger rings normally come in a variety of sizes including half sizes. The fact that so many ring sizes are needed requires that a large amount of inventory be on hand if the merchant wishes to provide expedient service to prospective customers. In some cases, a ring size may be enlarged by use of a special expanding ring mandrel. However, the same is time consuming and can sometimes result in the ring being damaged.

It is therefore a principal object of the invention to provide an adjustable finger ring which may accommodate various ring finger sizes.

Another object of the invention is to provide an adjustable finger ring whether the ring be of the square shank type, or the one-half round shank type.

Yet Another object of the invention is to provide an adjustable finger ring which is easy to adjust.

Still Another object of the invention is to provide an adjustable finger ring which is durable in use, refined in appearance and economical to manufacture.

These and other objects will be apparent to those skilled in the art.

SUMMARY OF THE INVENTION

In one form of the embodiment, the ring has a square shank while in another embodiment, the ring has a one-half round shank. In the first embodiment, the square shank is split and has its opposite ends spaced apart to define an adjustment gap. A spring is soldered in one end of the ring shank and extends outwardly therefrom. A serrated or toothed insert is positioned on the outer surface of the ring and is held in place by a channel-shaped member which is soldered to the other end of the ring shank. The spring is received by the serrations or the teeth of the insert in a yieldable fashion so that the ring size may be enlarged to accommodate larger finger sizes. A cap embraces the inner portion of the ring shank at the adjustment gap and is secured to the channel member to maintain the channel member and serrated or toothed insert in place. In the second embodiment, the channel member itself is serrated or toothed to eliminate the need of a separate insert. A cap is secured to the channel member as in the first embodiment.

DESCRIPTION OF THE PREFERRED EMBODIMENT

Figure 1:
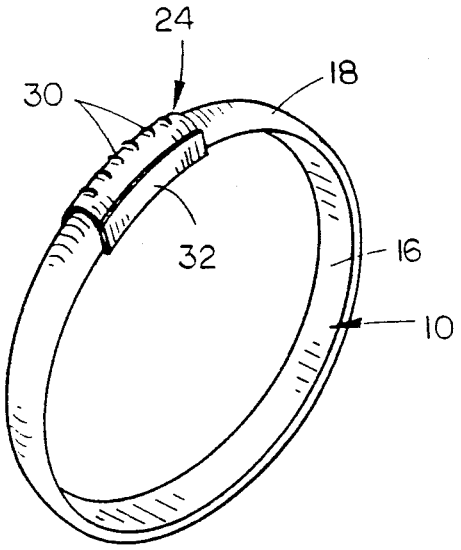
FIG. 1 is a perspective view of one form of the invention.
Figure 3:
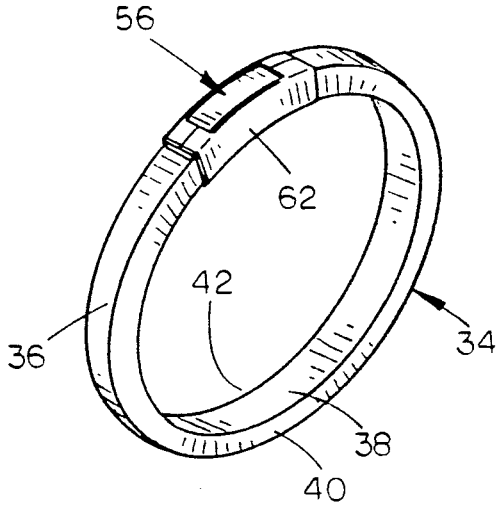
FIG. 3 is a perspective view of a second embodiment of the invention.
Figure 2:
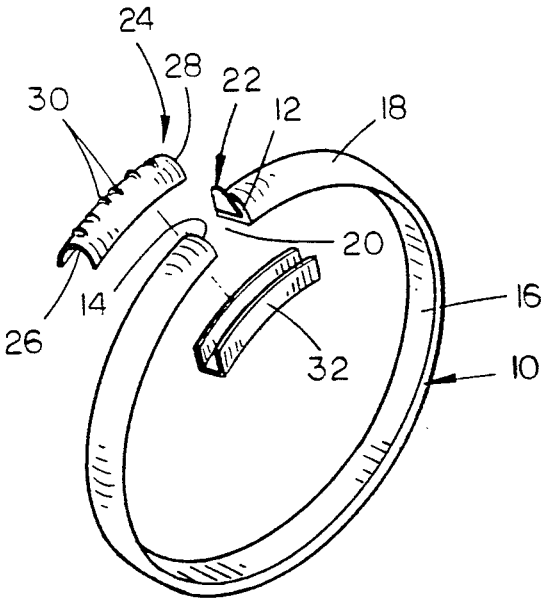
FIG. 2 is an exploded perspective view of the embodiment of FIG. 1.
Figure 4:
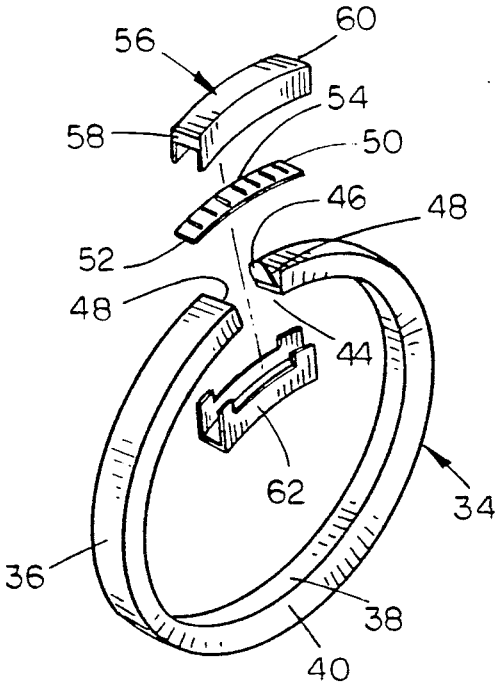
FIG. 4 is an exploded perspective view of the embodiment of FIG. 3.
Figure 6:
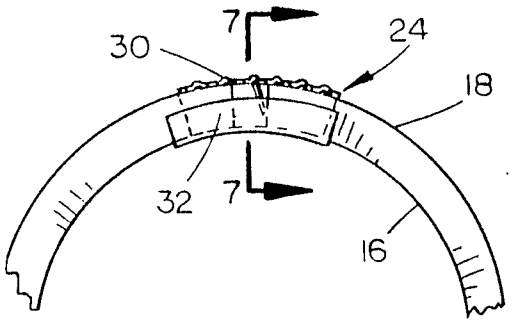
FIG. 6 is a side elevational view of the embodiment of FIG. 5.
Figure 5:
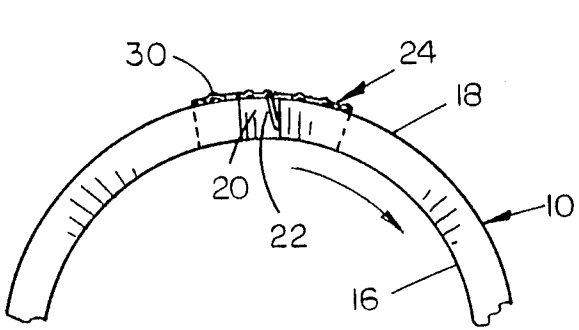
FIG. 5 is a side view of the embodiment of FIG. 1 with portions thereof removed and cut away to more fully illustrate the invention.
Figure 7:
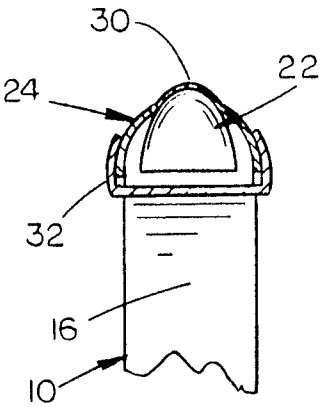
FIG. 7 is an enlarged side elevational view as seen on line 7—7 of FIG. 6.
Figure 9:
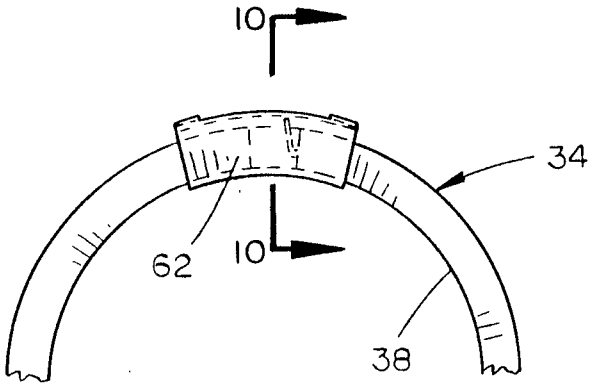
FIG. 9 is a side elevational view of the embodiment of FIG. 8.
Figure 8:
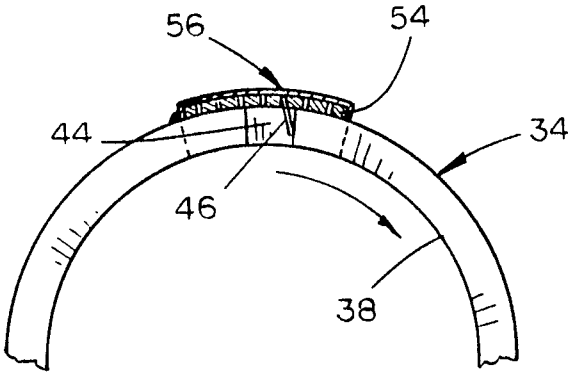
FIG. 8 is a view similar to FIG. 5 except that the embodiment of FIG. 3 is illustrated.
Figure 10:
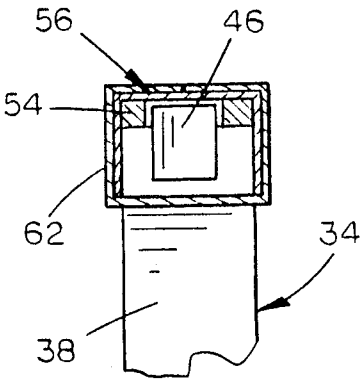
FIG. 10 is an enlarged side elevational view as seen on lines 10—10 of FIG. 9.

In FIGS. 1, 2, 5, 6 and 7, the numeral 10 refers to a semi-round or semi-circular ring shank having spaced apart ends 12 and 24. Shank 10 has an inner surface 16 and an arcuate or semi-round outer surface 18. Ends 12 and 14 are separated as illustrated in FIG. 2 to define an adjustment gap 20.

A spring 22 is inserted into a slit formed in end 12 of shank 10 and extends outwardly therefrom. An elongated, curved or arcuate channel-member 24 is provided and includes ends 26 and 28. Channel member 24 embraces the outer surface 18 of shank 10 and bridges the adjustment gap 20 as seen in FIG. 2. End 26 of channel 24 is soldered to shank 10 adjacent end 14. Channel member 24 is provided with a plurality of spaced apart teeth 30 which are adapted to receive the outer end of the spring 22 to maintain the ring shank in the particular size to which it has been adjusted through the use of a special ring mandrel. Cap 32 embraces the inner portion of the ring shank 10 and practically embraces the channel member 24 as seen in the drawings and is crimped thereonto to maintain the channel member 24 in position so that the spring 22 cannot disengage from the channel member 24.

Thus, shank 10 can be adjustably enlarged or expanded to accommodate a variety of ring sizes with the spring 22 being received in one of the notches or teeth 30 to maintain the shank 10 in that particular diameter or size. The fact that the shank 10 can be readily adjusted to accommodate a verity of ring sizes, including half sizes, enables the merchant to substantially reduce his/her inventory of rings.

In FIGS. 3, 4, 8–10, the numeral 34 refers to a ring shank having a square cross-section. Shank 34 includes an outer surface 36, inner surface 38, and sides 40 and 42. Shank 34 is split, as was shank 10, to define an adjustment gap 44. Spring 46 is mounted in end 48 of shank 34 and extends outwardly in much the same fashion as spring 22 in shank 10.

The numeral 50 refers to an elongated, toothed or serrated insert 50 having end 52 soldered to shank 34 adjacent end 48. Insert 50 bridges the adjustment gap 44 and is provided with a plurality of teeth or notches 54 which are adapted to engage the outer end of spring 46 as in the embodiment of FIG. 1.

An elongated, curved channel member 56, including ends 58 and 60, embraces insert 50 and has its end 50 soldered to shank 34 adjacent end 48 to maintain insert 50 in position. An elongated, curved cap 62 embraces the inner surface of ring 34 and embraces the sides of channel member 56 and is crimped thereto to maintain the components in place. The shank 34 may be adjusted in the same fashion as the embodiment previously described.

Although insert 50 is described as being a separate component, insert 50 could be eliminated if channel member 56 includes teeth or serrations much like channel member 24 in the embodiment of FIG. 1.

Thus, it can be seen that a novel adjustable finger ring has been provided which may be easily expanded to fit a variety of finger sizes. The adjustment features of the ring are such that the ring may be easily adjusted without detracting from the aesthetic qualities of the ring. Although the preferred embodiments disclosed herein are designed to permit the expansion or enlargement of the ring shank, means could be provided to permit the shanks to be made smaller if so desired. Thus it can be seen that the invention accomplishes at least all of the stated objectives.

I claim:

1. An adjustable finger ring, comprising:

a substantially ring-shaped shank member having spaced-apart first and second ends defining an adjustment gap therebetween, said shank member having a substantially square cross-section, said shank member having inner and outer surfaces, and opposite sides, a spring means operatively secured to said first end of said shank member and extending toward said second end and extending outwardly of said outer surface, an elongated curved, toothed insert positioned at the outer surface of said shank member, said toothed insert bridging said adjustment gap, said toothed insert having spaced-apart teeth extending therefrom toward said shank member for selective engagement with said spring means whereby the ring size of said shank member may be varied by changing the relationship between said spaced-apart teeth and said spring means, an elongated, curved channel member embracing at least a portion of the outer surface and side portions of said shank member, said channel member having opposite ends, one end of said channel member being secured to said second end of said shank member, said toothed insert being positioned between said channel member and said shank member, and an elongated, curved cap means bridging said adjustment gap and embracing at least a portion of said inner surface of said shank member and the sides thereof, said cap means at least partially embracing said channel member and being operatively secured thereto.

2. The adjustable finger ring of claim 1 wherein said channel member includes means for maintaining said toothed insert between said channel member and said shank member.

3. The adjustable finger ring of claim 1 wherein said one end of said channel member is soldered to said shank member.

4. The adjustable finger ring of claim 1 wherein said cap means is crimped onto the sides of said channel member.

5. The adjustable finger ring of claim 1 wherein said cap means is channel-shaped.

6. An adjustable finger ring, comprising:

a substantially ring-shaped shank member having spaced-apart first and second ends, said shank member having a substantially semi-circular cross-section, said shank member having a flat inner surface and a curved outer surface defining curved sides, a spring means operatively secured to said first end of said shank member and extending toward said second end and extending outward of said outer surface, an elongated toothed channel member embracing a portion of the outer surface of said shank, member, said toothed channel member bridging said adjustment gap, one end of said channel member being secured to one end of said shank member, said toothed channel member having spaced-apart teeth extending therefrom toward said shank member for selective engagement with said spring means whereby the size of said shank member may be varied by changing the relationship between said spaced-apart teeth and said spring means, and a cap means bridging said adjustment gap and embracing said at least a portion of said inner surface of said shank member and the sides of said outer surface, said cap means at least partially embracing said channel member and being operatively secured thereto.

7. An adjustable finger ring, comprising:

a substantially ring-shaped shank member having spaced-apart first and second ends defining an adjustment gap therebetween, said shank member having inner and outer surfaces, and opposite sides, a spring means operatively secured to said first end of said shank member and extending toward said second end and extending outwardly of said outer surface, an elongated curved, toothed insert positioned at the outer surface of said shank member, said toothed insert bridging said adjustment gap, said toothed insert having spaced-apart teeth extending therefrom toward said shank member for selective engagement with said spring means whereby the ring size of said shank member may be varied by changing the relationship between said spaced-apart teeth and said spring means, an elongated, curved channel member embracing at least a portion of the outer surface and side portions of said shank member, said channel member having opposite ends, one end of said channel member being secured to said second end of said shank member, said toothed insert being positioned between said channel member, and said shank member, and an elongated, curved cap means bridging said adjustment gap and embracing at least a portion of inner surface of said shank member and the sides thereof, said cap means at least partially embracing said channel member and being operatively secured thereto.

8. An adjustable finger ring, comprising:

a substantially ring-shaped shank member having spaced-apart first and second ends, said shank member having a substantially semi-circular cross-section, said shank member having an inner surface and an outer surface defining sides, a spring means operatively secured to said first end of said shank member and extending toward said second end and extending outward of said outer surface, an elongated toothed channel member embracing a portion of the outer surface of said shank member, said toothed channel member bridging said adjustment gap, one end of said toothed channel member being secured to one end of said shank member, said toothed channel member having spaced-apart teeth extending therefrom toward said shank member for selective engagement with said spring means whereby the size of said shank member may be varied by changing the relationship between said spaced-apart teeth and said spring means, and a cap means bridging said adjustment gap and embracing at least a portion of said inner surface of said shank member and the sides of said outer surface, said cap means at least partially embracing said channel member and being operatively secured thereto.

* * * * *